US007143955B2

(12) United States Patent
Geiger et al.

(10) Patent No.: US 7,143,955 B2
(45) Date of Patent: Dec. 5, 2006

(54) FUEL INJECTION DEVICE FOR AN INTERNAL COMBUSTION ENGINE

(75) Inventors: Wolfgang Geiger, Remshalden (DE); Peter Grabandt, Remseck (DE); Uwe Baerenwaldt, Freiberg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/544,716

(22) PCT Filed: Oct. 14, 2003

(86) PCT No.: PCT/DE03/03415

§ 371 (c)(1),
(2), (4) Date: Aug. 5, 2005

(87) PCT Pub. No.: WO2004/070194

PCT Pub. Date: Aug. 19, 2004

(65) Prior Publication Data

US 2006/0219803 A1 Oct. 5, 2006

(30) Foreign Application Priority Data

Feb. 6, 2003 (DE) ..... 103 04 742

(51) Int. Cl.
*F02M 41/16* (2006.01)

(52) U.S. Cl. ..... 239/96; 239/585.1; 239/88; 239/600; 239/533.9; 123/470; 335/257; 335/278; 277/596; 277/598

(58) Field of Classification Search ..... 239/88, 239/96, 600, 585.1, 585.3, 533.3, 533.9; 123/447, 470; 335/220, 255, 257, 278; 277/591, 277/593, 596, 598; 251/129.15, 129.18
See application file for complete search history.

(56) References Cited

U.S. PATENT DOCUMENTS

| | | | | |
|---|---|---|---|---|
| 4,382,242 | A * | 5/1983 | Colvin et al. | 335/255 |
| 5,339,063 | A * | 8/1994 | Pham | 239/88 |
| 6,367,769 | B1 * | 4/2002 | Reiter | 251/129.15 |
| 6,611,186 | B1 * | 8/2003 | Hanson et al. | 335/220 |
| 6,799,734 | B1 * | 10/2004 | Hans | 239/585.1 |
| 2002/0020769 | A1 | 2/2002 | Adachi et al. | |
| 2002/0092932 | A1 | 7/2002 | Ricco et al. | |

FOREIGN PATENT DOCUMENTS

| | | |
|---|---|---|
| DE | 40 23 828 A1 | 1/1992 |
| EP | 1 150 001 A2 | 10/2001 |
| EP | 1 219 823 A1 | 7/2002 |

* cited by examiner

*Primary Examiner*—Steven J. Ganey
(74) *Attorney, Agent, or Firm*—Ronald E. Greigg

(57) ABSTRACT

A fuel injection apparatus having at least one solenoid valve for controlling the fuel injection that is contained in a housing part and a solenoid assembly having a magnetic coil and a magnet armature inserted into a recess of the housing part. A cover piece that can be attached to the housing part fixes the solenoid assembly in the housing part. A spring element is disposed between the cover piece and the solenoid assembly and clamps the solenoid assembly in the housing part. At least one securing element is formed onto the spring element and is of one piece with it, which secures the spring element to the housing part and secures the solenoid assembly in the recess of the housing part without the cover piece being attached to the housing part.

20 Claims, 5 Drawing Sheets

24
20
10
26
16
52
58
18
57
22
56
57
59
60
50
49
51
55
29
48
36
28
28
30
54
35
32
46
44
34
42
40
12
41
38

FUEL INJECTION DEVICE FOR AN INTERNAL COMBUSTION ENGINE

CROSS-REFERENCE TO RELATED APPLICATIONS

This application is a 35 USC 371 application of PCT/DE 03/03415 filed on Oct. 14, 2003.

BACKGROUND OF THE INVENTION

1. Field of the Invention

The invention is directed to an improved fuel injection apparatus for an internal combustion engine.

2. Description of the Prior Art

A fuel injection apparatus of the type with which this invention is concerned is known from the literature, for example from Diesel Motor Management, Verlag Vieweg, 2nd edition, 1998, p. 246. This fuel injection apparatus has a solenoid valve for controlling the fuel injection. The solenoid valve is inserted into a housing part and has a solenoid assembly with a magnetic coil and a magnet armature. The housing part has a cover piece attached to it that holds the solenoid assembly of the solenoid valve in the housing part. With the insertion of the solenoid assembly into the housing part, the problem arises that the solenoid assembly is only fixed in place when the cover piece is attached to the housing part so that before attachment of the cover piece, the solenoid assembly can fall back out of the housing part. In order to avoid unnecessary assembly steps, the cover piece should preferably be attached to the housing part only after the function of the solenoid assembly has been tested, but there is the danger that the solenoid assembly will fall out during the function testing. Furthermore, in this known fuel injection apparatus, it is not possible to compensate for different lengths of the solenoid assembly so that in some cases, it is not fixed securely in the housing part.

SUMMARY AND ADVANTAGES OF THE INVENTION

The fuel injection apparatus according to the invention has the advantage over the prior art that the solenoid assembly is fixed in the housing part before the attachment of the cover piece. In addition, the spring element makes it possible to compensate for the length of the solenoid assembly and therefore permits it to be securely fixed. The embodiment of the at least one securing element so that it is of one piece with the spring element means that only one additional component is required.

Advantageous embodiments and modifications of the fuel injection apparatus according to the invention are disclosed. One embodiment of the spring element in the form of a disc spring requires only a small amount of space, while another permits a secure fixing of the spring element and therefore also of the solenoid assembly.

BRIEF DESCRIPTION OF THE DRAWINGS

Several exemplary embodiments of the invention are explained in detail herein below, with reference to the drawings, in which.

DESCRIPTION OF THE PREFERRED EMBODIMENTS

Figure 1:
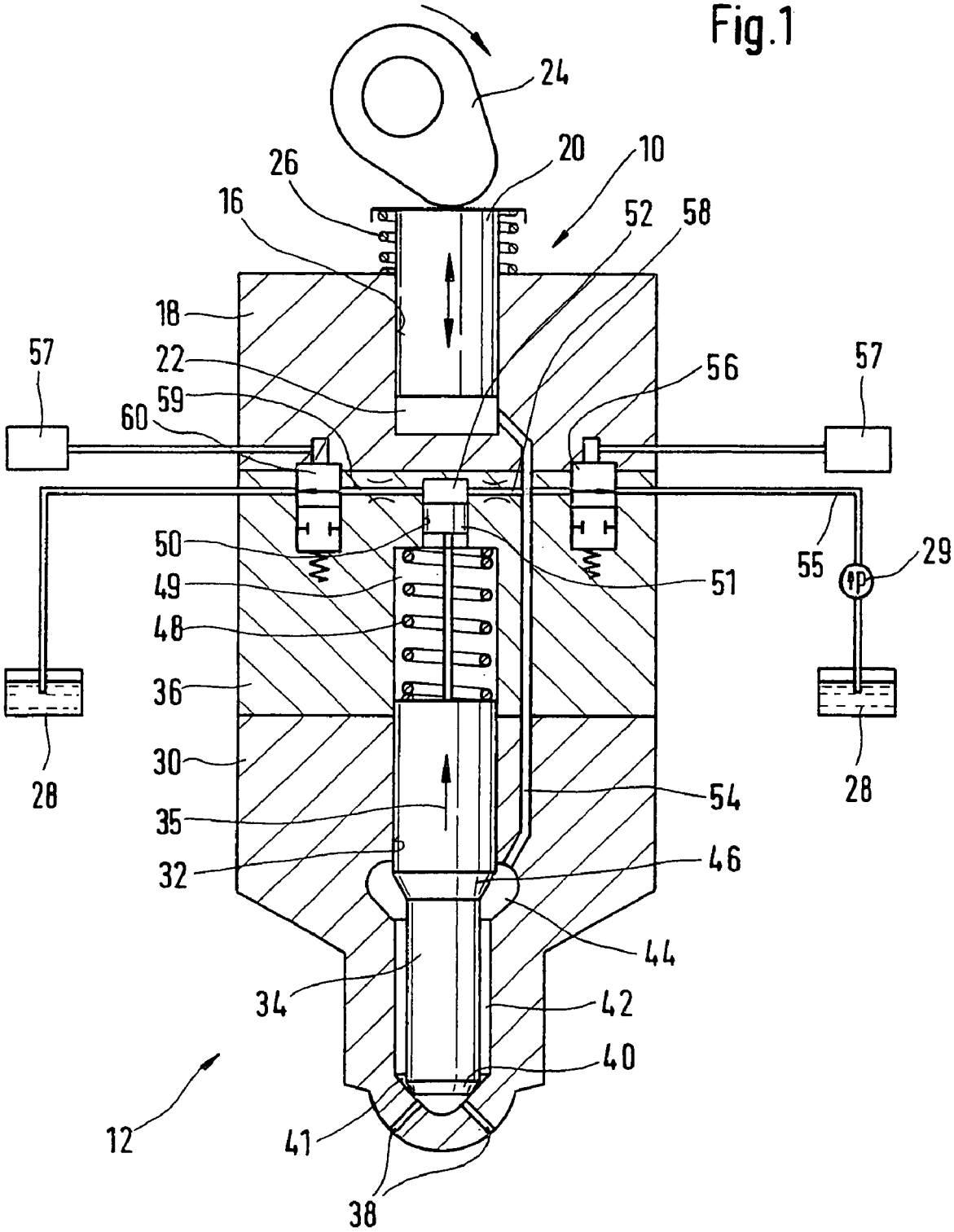
FIG. 1 is a sectional view schematically showing a detail of a prior art fuel injection apparatus for an internal combustion engine with a solenoid valve.

FIG. 1 shows a schematic depiction of a fuel injection apparatus for an internal combustion engine, for example of a motor vehicle. The engine is preferably an autoignition engine and has one or more cylinders. The fuel injection apparatus can be embodied, for example as shown in FIG. 1, in the form of a unit injector that has a high-pressure fuel pump 10 and a fuel injection valve 12 for each cylinder of the engine, which are incorporated into a common component. The unit injector is provided with at least one solenoid valve 56, 60 for controlling the fuel injection. Alternatively, the fuel injection apparatus can also be embodied as a unit pump in which a high-pressure fuel pump and a fuel injection valve are likewise provided for each cylinder of the engine, but are separate from each other and are connected to each other via a hydraulic line. The high-pressure fuel pump or the fuel injection valve of the unit pump is provided with a solenoid valve for controlling the fuel injection. Furthermore, the fuel injection apparatus can also be embodied as a common rail system in which a high-pressure fuel pump supplies fuel into a reservoir that is connected to injectors provided at the cylinders of the engine, each of which is provided with a solenoid valve for controlling the fuel injection. Moreover, the fuel injection apparatus can also be embodied as a fuel injection pump that supplies highly pressurized fuel and is connected to the fuel injection valves provided at the cylinders of the engine; the fuel injection pump is provided with a solenoid valve for controlling the high-pressure generation and therefore the fuel injection.

The invention will be explained below in conjunction with its use in a unit injector, but it can also be transferred to the above-mentioned other embodiments of fuel injection apparatuses. The high-pressure fuel pump 10 has a pump piston 20, which is guided in a sealed fashion in a cylinder bore 16 of a pump body 18 and defines a pump working chamber 22 in the cylinder bore 16. A cam 24 of a camshaft of the engine sets the pump piston 20 into a stroke motion at least indirectly, for example via a rocker, counter to the force of a return spring 26. A fuel-supply pump 29, for example, supplies fuel from a fuel tank 28 to the pump working chamber 22 during the intake stroke of the pump piston 20.

The fuel injection valve 12 has a valve body 30, which is connected to the pump body 18, which can be composed of a number of parts, and which contains a bore 32 in which an injection valve element 34 is guided so that it can slide longitudinally in a sealed fashion. An intermediate body 36 is disposed between the valve body 30 and the pump body 18. In its end region oriented toward the combustion chamber of the engine cylinder, the valve body 30 has at least one, preferably several injection openings 38. The injection valve element 34, in its end region oriented toward the combustion chamber, has a for example conical sealing surface 42 that cooperates with a valve seat 41 embodied in the end region of the valve body 30 oriented toward the combustion chamber; the injection openings 38 branch off from this valve seat 41 or branch off downstream of it. Between the injection valve element 34 and the bore 32 leading to the valve seat 41, the valve body 30 contains an annular chamber 42, whose end region oriented away from the valve seat 41, by means of a radial expansion of the bore 32, transitions into a pressure chamber 44 encompassing the injection valve element 34. At the same level as a pressure chamber 44, the injection valve element 34 has a pressure shoulder 46, which is oriented toward the valve seat 41 and is formed by a cross-sectional change. A prestressed closing spring 48 engages the end of the injection valve element 34 oriented away from the combustion chamber and pushes the injection valve element 34 toward the valve seat 41. The closing spring 48 is disposed in a spring chamber 49 that is contained in the valve body 30 or in the intermediate body 36 and adjoins the bore 32.

The end of the spring chamber 49 oriented away from the pressure chamber 44 adjoins a bore 50 with a smaller diameter. A control piston 51 is guided in a sealed fashion in the bore 50 and delimits a control pressure chamber 52 in the bore 50. The control piston 51 rests against the injection valve element 34 and, depending on the pressure prevailing in the control pressure chamber 52, generates a force in the closing direction on the injection valve element 34 that boosts the action of the closing spring 48. From the pump working chamber 22, a conduit 54 leads through the pump body 16, the intermediate body 36, and the valve body 30, into the pressure chamber 44 of the fuel injection valve 12. From the conduit 54, a connection 55 leads to the fuel-supply pump 29 and to the fuel tank 28. A first solenoid valve 56 embodied as a 2/2-way valve controls the connection 55. An electronic control unit 57 that will be described in more detail below triggers the solenoid valve 56. Another conduit 58 leads from the conduit 54 into the control pressure chamber 52 and the control pressure chamber 52 has a connection 59 to a discharge region, for example a return into the fuel tank 28. The control unit 57 also triggers a second solenoid valve 60 that controls the connection 59 of the control pressure chamber 52 to the discharge region. The first solenoid valve 56 controls the pressure buildup in the pump working chamber 22 of the high-pressure fuel pump 10 and the second solenoid valve 60 controls the pressure in the control pressure chamber 52 and therefore controls the opening of the fuel injection valve 12. The second solenoid valve 60 and the control pressure chamber 52 can also be omitted, in which case the closing spring 48 alone determines the opening of the fuel injection valve 12. If the pressure prevailing in the pressure chamber 44 and acting on the pressure shoulder 46 exerts a greater force on the injection valve element 34 than the closing spring 48 and the pressure prevailing in the control pressure chamber 52, then the injection valve element 34 moves in the opening direction 35 and unblocks the injection openings 38.

Figure 2:
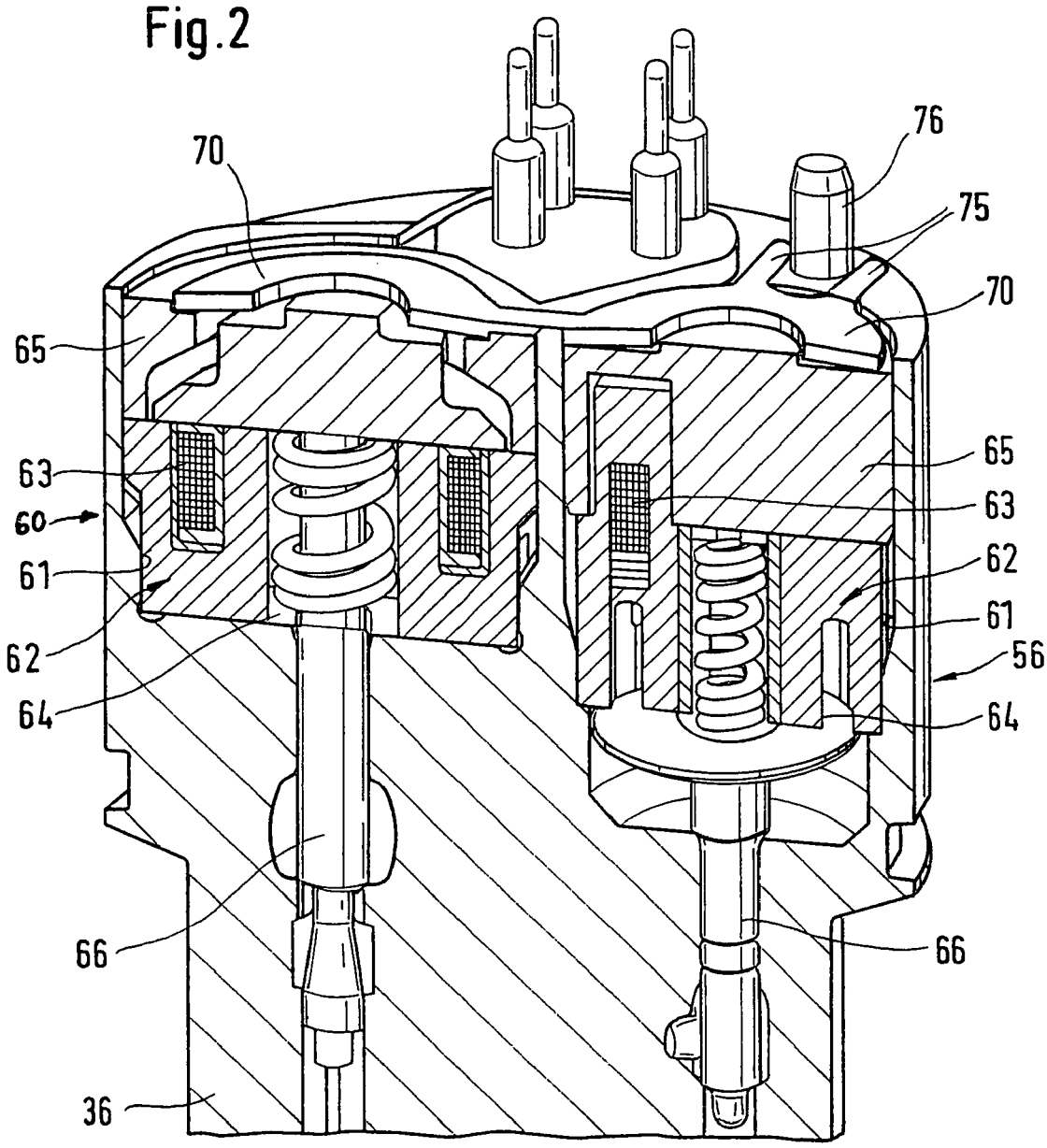
FIG. 2 shows a longitudinal section through a housing part of the fuel injection apparatus according to FIG. 1 with a spring element according to a first exemplary embodiment.

FIG. 2 shows an enlargement of the intermediate body 36, with the two solenoid valves 56 and 60 contained in it. The intermediate body 36 has two recesses 61 leading from its end surface oriented toward the pump body 16, each of which has a solenoid assembly 62 of the respective solenoid valves 56, 60 inserted into it. Each solenoid assembly 62 has a magnetic coil 63 and a magnet armature 64 and may also include other components. Toward the open end of the recesses 61, a respective pressure piece 65 covers each of the solenoid assemblies 62. The cross sections of the recesses 61 and the solenoid assemblies 62 are matched to one another, for example are circular. Each magnet armature 64 is connected to a respective solenoid valve element 66 that opens or closes the connection 55 between the conduit 50 and the fuel-supply pump 29 or that opens or closes the connection 59 between the control pressure chamber 52 and the discharge region. When the magnetic coil 63 is without current, the solenoid valve element 66 of the respective solenoid valve 56, 60 is disposed in a first position in which it has opened or closed the connection 55, 59 and when the magnetic coil 63 is supplied with current, the solenoid valve element 66 of the respective solenoid valve 56, 60 is moved into a second position in which it correspondingly closes or opens the connection 55, 59.

Figure 3:
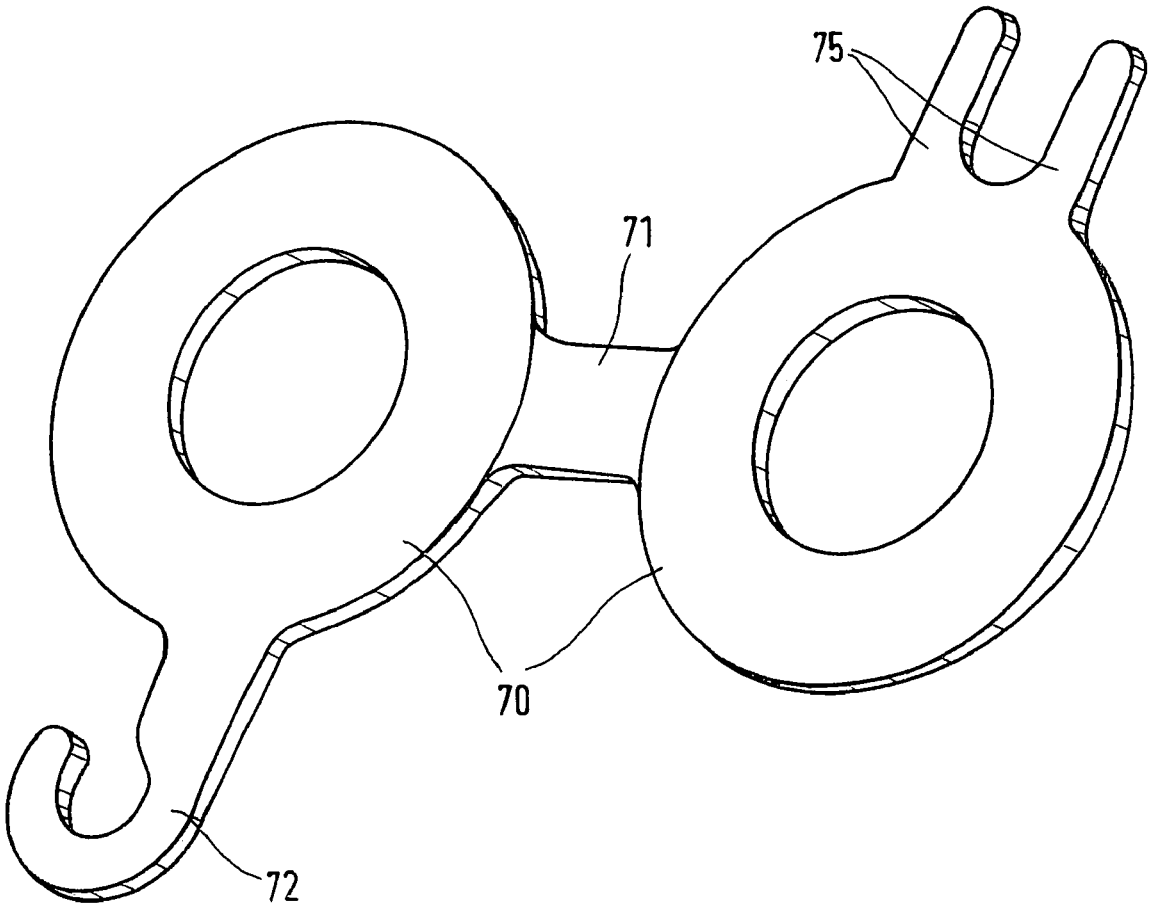
FIG. 3 shows a perspective view of the spring element according to the first exemplary embodiment.
Figure 4:
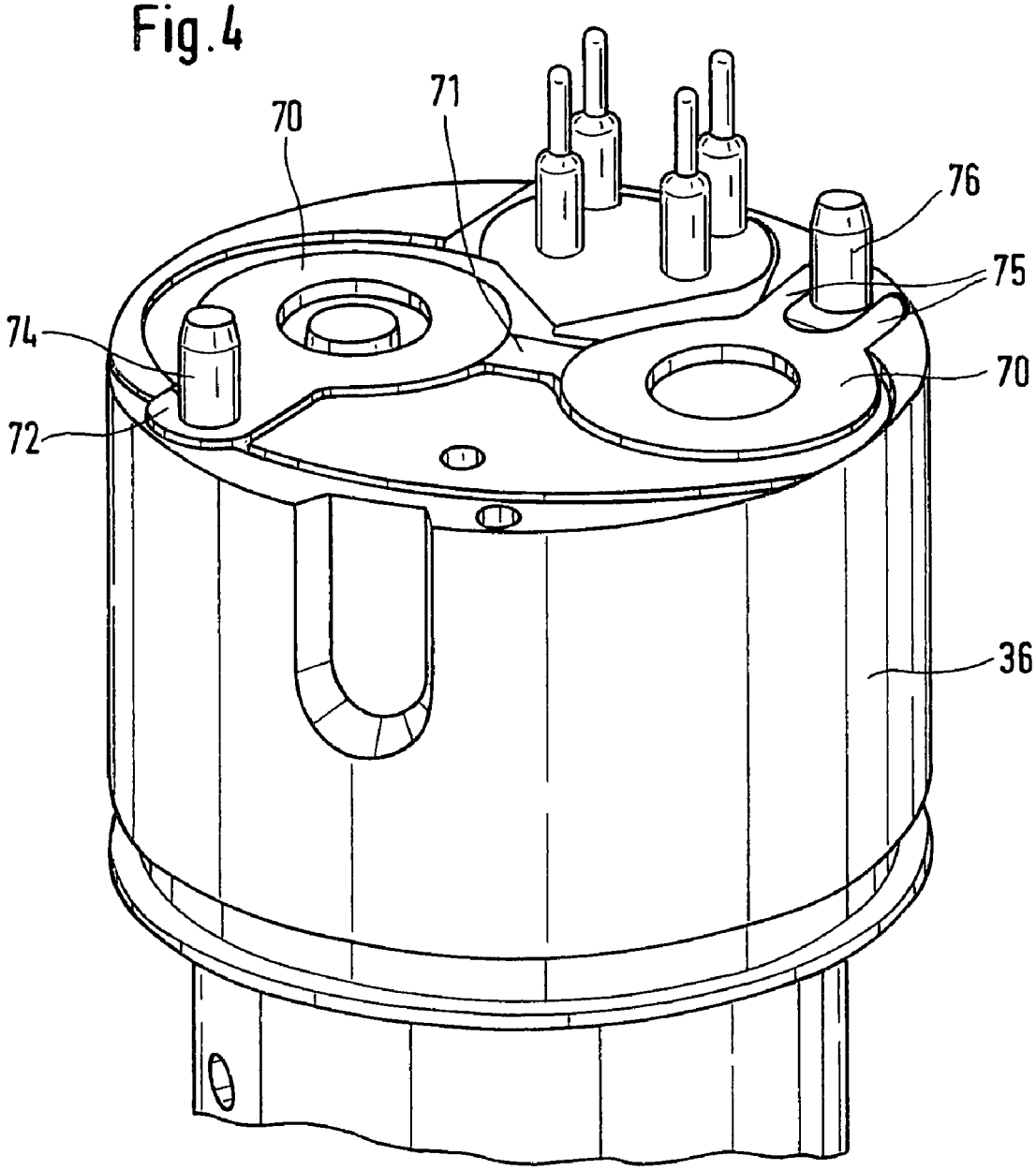
FIG. 4 shows a perspective view of the housing part with the spring element according to the first exemplary embodiment.

In a first exemplary embodiment shown in FIGS. 2 to 4, the solenoid assemblies 62 of the two solenoid valves 56, 60 are each secured in the recesses 61 by a respective spring element 70. A spring element 70 embodied in the form of a round disc spring is provided for each solenoid assembly 62 and, via the respective pressure piece 65, clamps the solenoid assembly 62 in the recess 61 in an axial direction, i.e. in the direction of the longitudinal axis of the recess 61 and of the solenoid assembly 62. The two spring elements 70 here are embodied as being of one piece with each other and are connected to each other via a bridge piece 71 shown in FIG. 3. The spring elements 70 are curved in the axial direction in order to produce the required clamping action. The spring elements 70 also have securing elements that are formed onto them and are of one piece with them, which permit the spring elements 70 to be affixed to the intermediate body 36 and will be described in more detail below. One of the spring elements 70 has a securing element 72 in the form of a hook formed onto it. The hook 72 protrudes approximately radially out from the spring element 70 and its free end is curved inward into a U-shape. The hook 72 is preferably embodied as flexible and engages the intermediate body 36 at least indirectly. A pin 74 that extends at least approximately parallel to the longitudinal axes of the recesses 61 is press-fitted into the end of the intermediate body 36 oriented toward the pump body 16. The hook 72 of the spring element 70 is hooked onto the pin 74 and encompasses the part of it that protrudes from the intermediate body 36. Alternatively, the hook 72 can also be press-fitted onto the pin 74. The other spring element 70 has another securing element that is formed onto it and of one piece with it, which is comprised of two lugs 75 that are offset from each other in the circumferential direction and engage the intermediate body 36 at least indirectly. The lugs 75 laterally embrace another pin 76 that is press-fitted into the intermediate body 36. The end of the intermediate body 36 oriented toward the pump body 18 is provided with indentations for the securing elements 72 and 75 and for the bridge piece 71 connecting the two spring elements 70 so that they do not protrude out from the end surface of the intermediate body 36.

When the spring elements 70 are inserted into the recesses 61, the hook 72 encompasses the pin 74 or is press-fitted onto the pin 74 and the lugs 75 embrace the pin 76, thus producing a clamped connection between the spring elements 70 and the pins 74, 76 so that the spring elements can no longer fall out of the intermediate body 36. The spring elements 70 consequently fix the solenoid assemblies 62 of the solenoid valves 56, 60 in the intermediate body 36 so that they cannot fall out. It is therefore possible to test the function of the solenoid assemblies 62 of the solenoid valves 56, 60 inserted into the recesses 61 of the intermediate body 36, without the danger of the solenoid assemblies 62 falling out. The spring elements 70 also prevent the solenoid assemblies 62 inserted into the intermediate body 36 from falling out during subsequent transport before final assembly of the fuel injection apparatus. During subsequent assembly of the fuel injection apparatus, the pump body 18 and the valve body 30 are fitted together with the intermediate body 36; the pump body 18 constitutes a cover piece that axially compresses the spring elements 70 and by means of them, clamps the solenoid assemblies 62 into the recesses 61 of the intermediate body 36, consequently fixing them without play.

Figure 5:
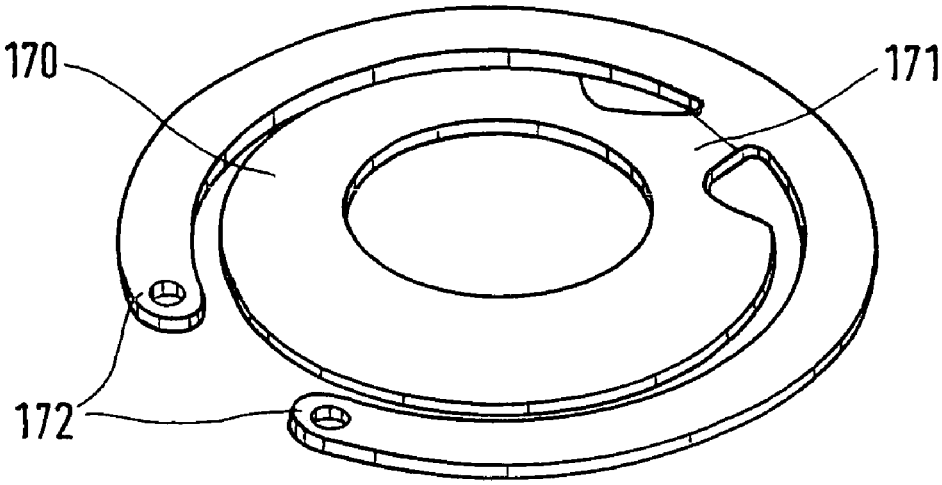
FIG. 5 shows a perspective view of the spring element according to a second exemplary embodiment.
Figure 6:
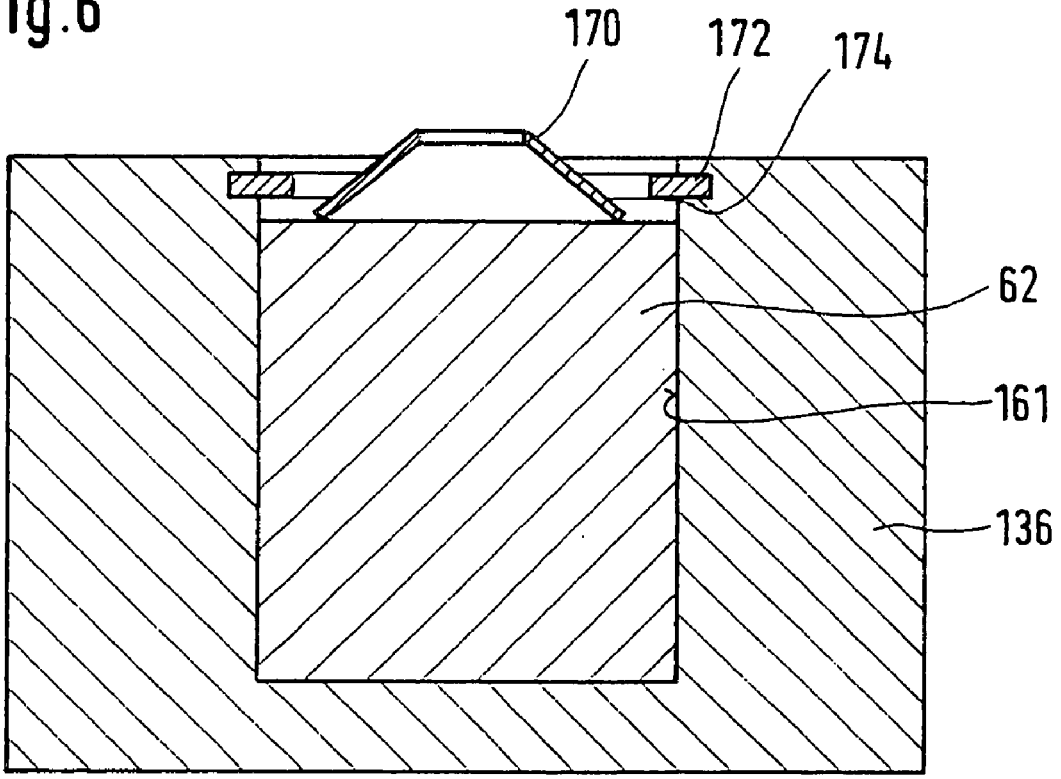
FIG. 6 shows a detail of the housing part with the spring element according to the second exemplary embodiment.

FIGS. 5 and 6 show a second exemplary embodiment of the spring element 170. In this case, only one spring element 170 is provided for one of the solenoid valves 56, 60. It is possible here that only the first solenoid valve 56 and a spring element 170 for it are provided or that two solenoid valves 56, 60 are provided, each with a separate spring element 170. The spring element 170 is embodied as a disc spring with a circular cross section and, encompassing this disc spring, a retaining element 172 in the form of a securing ring that is formed onto it and of one piece with it. The securing ring 172 is formed onto the spring element 170, attached by a bridge piece 171 extending approximately in the radial direction. The securing ring 172 is designed so that it can be deformed elastically in the radial direction. Close to its end oriented toward the end surface of the intermediate body 136, the circumference of the recess 161 in the intermediate body 136 into which the solenoid assembly 62 is inserted has a cross-sectional enlargement 174 that forms an undercut and that can be constituted by an annular groove, an indentation, or a bore, into which the securing ring 172 can expand radially outward, engaging it in detent fashion. When relaxed, the diameter of the securing ring 172 is slightly greater than the diameter of the recess 161; when the spring element 170 is inserted into the recess 161, the securing ring 172 is elastically compressed in the radial direction and in the end position of the spring element 170, relaxes outward, engaging in the annular groove 174 in detent fashion. This fixes the spring element 170 to the intermediate body 136 and thus prevents the solenoid assembly 62 from falling out of the intermediate body 136. When the pump body 16 is fitted as a cover piece onto the intermediate body 136, the spring element 170 is compressed in the axial direction and thus secures the solenoid assemblies 62 in the intermediate body 136 without play.

The foregoing relates to preferred exemplary embodiments of the invention, it being understood that other variants and embodiments thereof are possible within the spirit and scope of the invention, the latter being defined by the appended claims.

The invention claimed is:

1. A fuel injection apparatus for an internal combustion engine, the apparatus comprising a housing part (36; 136)

at least one solenoid valve (56, 60) inserted into the housing part (36; 136) and operable for controlling the fuel injection, the at least one solenoid valve (56, 60) including a solenoid assembly (62), which has a magnetic coil (63) and a magnet armature (64) and which is inserted into a recess (61) of the housing part (36; 136), a cover piece (18) attaching the solenoid assembly (62) to and fixing the solenoid assembly (62) in the housing part (36; 136), a spring element (70; 170) disposed between the cover piece (18) and the solenoid assembly (62) and clamping the solenoid assembly (62) in the housing part (36; 136), and at least one securing element (72, 75; 172) formed onto and of one piece with the spring element (70; 170) securing the spring element (70; 170) to the housing part (36; 136) and secures the solenoid assembly (62) in the recess (61) of the housing part (36; 136), prior to the cover piece (18) being attached to the housing part (36; 136).

2. The fuel injection apparatus according to claim 1, wherein the spring element (70; 170) is embodied as a disc spring.

3. The fuel injection apparatus according to claim 2, wherein the at least one securing element (170) is embodied as a radially elastic securing ring that encompasses the spring element (170) and can engage with the housing part (136) in detent fashion.

4. The fuel injection apparatus according to claim 3, wherein the circumference of the recess (161) in the housing part (136) is provided with an undercut (174) in which the securing ring (172) can engage in detent fashion.

5. The fuel injection apparatus according to claim 2, wherein the at least one securing element (72) is embodied as a hook that protrudes out from the spring element (70), preferably at least approximately in the radial direction, and adapted to be hooked at least indirectly to the housing part (36).

6. The fuel injection apparatus according to claim 5, wherein the apparatus further comprises a pin (74) fastened to the housing part (36), and wherein the hook (72) can be hooked onto or press-fitted onto the pin (74).

7. The fuel injection apparatus according to claim 2, wherein the at least one securing element (75) is comprised of two lugs that are spaced apart from each other and protrude out from the circumference of the spring element (70), preferably at least approximately in the radial direction, and preferably embrace a pin fastened to the housing part (36) or can be press-fitted onto the pin.

8. The fuel injection apparatus according to claim 1, wherein the at least one securing element (170) is embodied as a radially elastic securing ring that encompasses the spring element (170) and can engage with the housing part (136) in detent fashion.

9. The fuel injection apparatus according to claim 8, wherein the circumference of the recess (161) in the housing part (136) is provided with an undercut (174) in which the securing ring (172) can engage in detent fashion.

10. The fuel injection apparatus according to claim 1, wherein the at least one securing element (72) is embodied as a hook that protrudes out from the spring element (70), preferably at least approximately in the radial direction, and adapted to be hooked at least indirectly to the housing part (36).

11. The fuel injection apparatus according to claim 10, wherein the apparatus further comprises a pin (74) fastened to the housing part (36), and wherein the hook (72) can be hooked onto or press-fitted onto the pin (74).

12. The fuel injection apparatus according to claim 11, wherein the at least one securing element (75) is comprised of two lugs that are spaced apart from each other and protrude out from the circumference of the spring element (70), preferably at least approximately in the radial direction, and preferably embrace a pin fastened to the housing part (36) or can be press-fitted onto the pin.

13. The fuel injection apparatus according to claim 11, wherein the at least one securing element (75) is comprised of two lugs that are spaced apart from each other and protrude out from the circumference of the spring element (70), preferably at least approximately in the radial direction, and preferably embrace a pin fastened to the housing part (36) or can be press-fitted onto the pin, and wherein a securing element comprised of the hook (72) and a securing element comprised of the lugs (75) are formed onto the spring element (70) and in that the securing elements (72, 75) are disposed offset from each other in the circumference direction on the spring element (70).

14. The fuel injection apparatus according to claim 13, wherein two solenoid valves (56, 60) are provided that each have a respective solenoid assembly (62) inserted into a recess (61) in the housing part (36), wherein each solenoid assembly (62) is associated with a spring element (70), and wherein the two spring elements (70) are embodied as being of one piece with each other.

15. The fuel injection apparatus according to claim 14, wherein a securing element comprised of the hook (72) is formed onto the one spring element (70) and a securing element comprised of the lugs (75) is formed onto the other spring element (70).

16. The fuel injection apparatus according to claim 10, wherein the at least one securing element (75) is comprised of two lugs that are spaced apart from each other and protrude out from the circumference of the spring element (70), preferably at least approximately in the radial direction, and preferably embrace a pin fastened to the housing part (36) or can be press-fitted onto the pin.

17. The fuel injection apparatus according to claim 10, wherein the at least one securing element (75) is comprised of two lugs that are spaced apart from each other and protrude out from the circumference of the spring element (70), preferably at least approximately in the radial direction, and preferably embrace a pin fastened to the housing part (36) or can be press-fitted onto the pin, and wherein a securing element comprised of the hook (72) and a securing element comprised of the lugs (75) are formed onto the spring element (70) and in that the securing elements (72, 75) are disposed offset from each other in the circumference direction on the spring element (70).

18. The fuel injection apparatus according to claim 17, wherein two solenoid valves (56, 60) are provided that each have a respective solenoid assembly (62) inserted into a recess (61) in the housing part (36), wherein each solenoid assembly (62) is associated with a spring element (70), and wherein the two spring elements (70) are embodied as being of one piece with each other.

19. The fuel injection apparatus according to claim 18, wherein a securing element comprised of the hook (72) is formed onto the one spring element (70) and a securing element comprised of the lugs (75) is formed onto the other spring element (70).

20. The fuel injection apparatus according to claim 1, wherein the at least one securing element (75) is comprised of two lugs that are spaced apart from each other and protrude out from the circumference of the spring element (70), preferably at least approximately in the radial direction, and preferably embrace a pin fastened to the housing part (36) or can be press-fitted onto the pin.

* * * * *